US005141115A

United States Patent [19]

Nicoll

[11] Patent Number: 5,141,115

[45] Date of Patent: Aug. 25, 1992

[54] CLUSTER BIN STORAGE SYSTEM

[76] Inventor: James D. Nicoll, 829 Randall, Troy, Mich. 48098

[21] Appl. No.: 671,081

[22] Filed: Mar. 18, 1991

[51] Int. Cl.[5] ..... A47F 5/08

[52] U.S. Cl. ..... 211/55; 211/88; 211/128

[58] Field of Search ..... 211/55, 88, 128, 87, 211/70.1, 130

[56] References Cited

U.S. PATENT DOCUMENTS 2,651,421 9/1953 King ..... 211/55

4,955,488 9/1990 Nicoll ..... 211/88

*Primary Examiner*—Blair M. Johnson

*Attorney, Agent, or Firm*—Krass & Young

[57] ABSTRACT

A cluster bin assembly includes a generally planar member which may be folded into a bin shaped configuration and mounted on a wall. The member includes hook-like portions which cooperate with wall brackets to retain the folded bin therein. The bin includes particularly configured supports for retaining the base thereof.

8 Claims, 2 Drawing Sheets

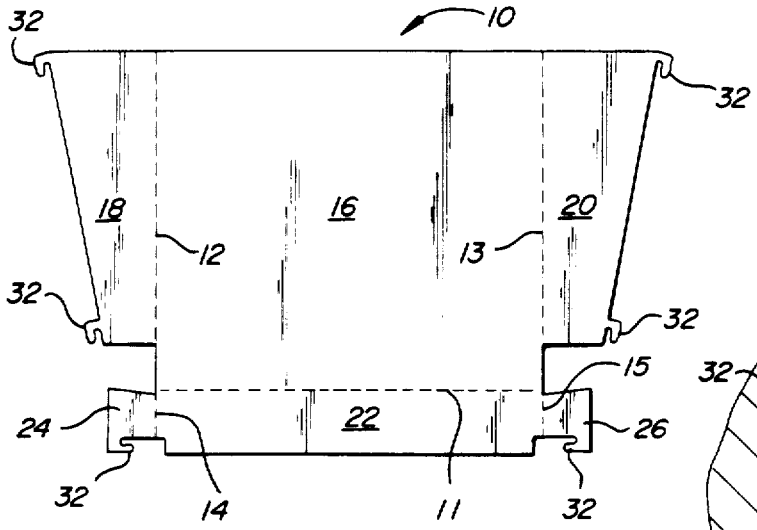
FIG-1
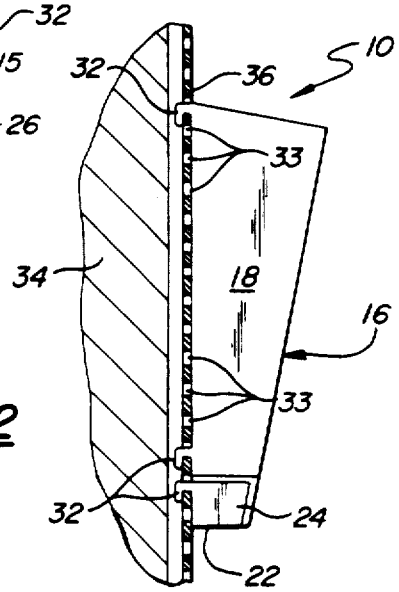
FIG-2
FIG-3A
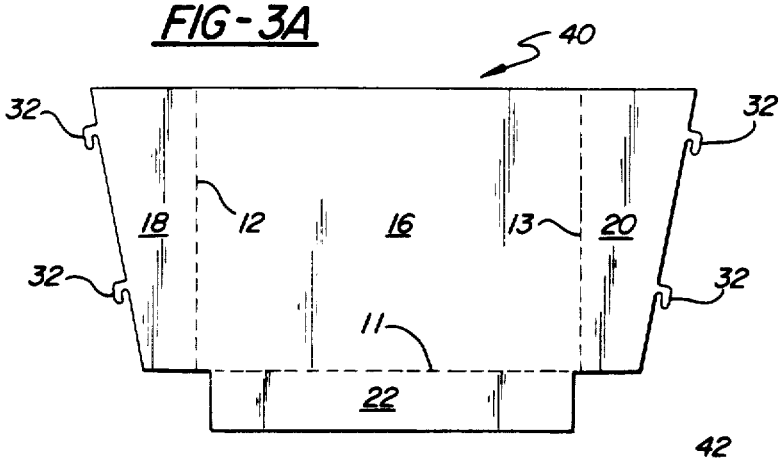
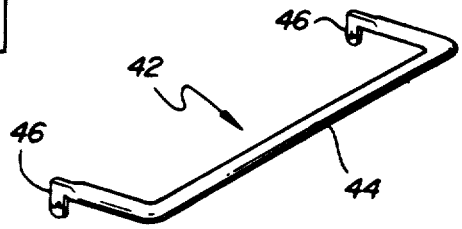
FIG-3B

CLUSTER BIN STORAGE SYSTEM

FIELD OF THE INVENTION

This invention relates generally to storage systems and more particularly to vertically mounted storage systems. Specifically, the present invention relates to storage systems comprised of a plurality of generally planar members which may be folded into bins and retainably attached to a wall.

BACKGROUND OF THE INVENTION

Since time immemorial, problems of storing and organizing items have plagued mankind. Evidence has been found that early humanoids utilized naturally occurring holes, niches and ledges for the storage of a variety of objects. Owing to the ever-increasing world population and the concomitant increase n the number of manufactured items, storage space has become a very significant concern.

In any building, particularly a commercial building, floor space is at a premium because it represents an expenditure of money. Anything that consumes large amounts of floor space relative to the revenue it generates represents a business loss. In businesses such as advertising agencies, architectural firms, engineering firms and the like large amounts of flat work are generated. This flat work, often of unusual and diverse sizes, may occupy space in an office for time periods ranging from days to years. Storage of such materials consumes inordinate amounts of otherwise productive floor space. Usually, flat work is set in inefficient piles or stood on edge against walls until needed. Such storage represents lost space that could be more productively utilized and furthermore can result in damage or loss of stored articles. Similar problems occur in the home where a variety of differently shaped objects such as books, magazines, tools and clothing must be stored.

What is needed is a flexible storage system capable of accommodating a variety of oversized or odd-shaped items in a manner which will remove them from the floor but yet leave them readily accessible for retrieval. Conventional shelving retains items upon a generally horizontal surface and is thus not well suited for storing large flat items. Various prior art approaches to wall mounted storage of flat items have been implemented; however, such methods have not fully addressed storage problems, particularly problems associated with the storage of oversized or odd-shaped items.

U.S. Pat. No. 2,105,594 of Henrich discloses a unitary, multi-compartmented, card rack fabricated from a single sheet of metal. The rack of Henrich is configured to be appropriately bent and to be nailed to a wall. By folding the appropriate interlocking tabs, the metal sheet may be configured to provide a plurality of compartments, each operative to retain a glass front plate. The rack of Henrich is not a modular item and hence the spacing and number of the associated compartments cannot be varied. Furthermore, the compartments of Henrich do not include a full bottom and cannot be utilized to store loose items such as pencils, small machine parts and the like.

U.S. Pat. No. 4,162,014 of Bobrick discloses a wall-mounted vertical file configured to hold business correspondence and the like. The file of Bobrick includes a primary tray which is affixed to the wall by nailing and a plurality of secondary trays supported by the primary tray. A similar arrangement is disclosed in U.S. Pat. No. 4,588,094 of Evans. Holders of this type are suited for light business correspondence; however they cannot adequately support relatively large art work, drawings and the like insofar as the entirety of the assembly is supported by the primary tray. Additionally, support arrangements of this type do not provide any flexibility in spacing and arrangement of the individual compartments.

U.S. Pat. No. 4,051,789 of Howitt and U.S. Pat. No. 3,247,809 of Thomson disclose shelving units which attach to wall tracks. Units of this type do not provide for vertical storage and as noted hereinabove are not suited for storage of large flat items.

What is needed is a storage system which may be adapted to provide for the vertical storage of a variety of items, particularly large flat items. It is further desirable that such storage systems allow for reach positioning and repositioning of the storage units. It is further desirable that such a system below cost and easy to use.

U.S. Pat. No. 4,955,488, the disclosure of which is incorporated herein by reference, discloses a wall-mounted storage system referred to as a "cluster bin system." This system includes a number of wall-mounted storage bins which may be utilized singly or in various combinations. The bins are of relatively low cost and may be stored in a flat, unassembled form until needed. They are light in weight and may be made in relatively large sizes for storage of oversized items.

The cluster bins of the U.S. Pat. No. 4,955,488 include bottom portions which engage, and are supported by, the wall to which the bins are affixed. This provides a positive and tight seal which enables the bins to retain a variety of small items therein. In accordance with the present invention, it has been recognized that the aforementioned bins may be modified so that the bottom thereof is supported by support elements such as tabs or separate support members which attach to the wall. These embodiments are of particular importance where the bins are affixed to irregular wall surfaces or when very large size bins are employed.

It has further been recognized in accord with the present invention that the fold provided by the living hinge of the bins enhances the rigidity and stability of the planar portions of the bins and hence the inclusion of extra hinge portions is particularly important where extra strong or very large bins are needed. These improvements further enhance the utility of cluster bin storage systems while retaining the advantages of low cost, flexibility and ease of use and storage. These and other advantages of the present invention will be readily apparent from the drawings, discussion, description and claims which follow.

BRIEF DESCRIPTION OF THE INVENTION

There is disclosed herein a cluster bin system which, in one embodiment, includes a unitary, planar member configured to be folded into a bin and attached to a wall. The planar member is divided into six regions by five generally linear, living hinges. The first region is separated from the remainder of the planar member by the first, second and third hinges and is configured to form the front of the bin when the planar member is folded along the hinges. The second and third hinges are separated from the first region by the second and third hinges respectively and they are approximate mirror images of one another. The second and third regions are configured to form the sides of the bin and each has attachment means associated therewith for fastening the bin to the wall. The fourth region is separated from the first region by the first hinge and it is configured to form the bottom of the bin. The bin of this embodiment further includes a fifth and sixth region separated from the fourth region by the fourth and fifth hinges respectively. The fifth and sixth regions are approximate mirror images of one another and each includes attachment means for fastening the bin to the wall and they are each configured to form tabs which support the base when the attachment means are fixed to the wall.

Another embodiment of cluster bin system includes a unitary, planar member configured to be folded into a bin and attached to a wall. This member is divided into four regions by three generally linear, living hinges. The first region has a length defined by the second and third hinges and a base width which is defined by the separation of the second and third hinges proximate the first hinge. This region is configured to form the front of the bin. The second and third regions in this embodiment are separated from the first region by the second and third hinges respectively and they are approximate mirror images of one another. Each of the second and third regions has a base which is generally linearly aligned with the first hinge and these regions are configured to form the side of the bin and include attachment means for fastening the bin to the wall. The planar member further includes a fourth region separated from the first region by the first hinge and having a width which is no greater than the base width of the first region. The fourth region is configured to form the bottom of the bin. This embodiment further includes a generally elongated support member having a length generally similar to the width of the fourth region and including attachment means associated with opposite ends thereof. The support member is operative to be retained upon the wall and to support the bottom of the bin when it is attached to the wall.

Yet another embodiment of bin comprises a unitary, planar member which is divided into four regions by three living hinges. The first region has a length defined by the second and third hinges and a base width defined by the separation of the second and third hinges proximate the first hinge. The first region forms the front of the bin. The second and third regions are separated from the first region by the second and third hinges respectively and they are approximate mirror images of one another. These regions have a base which is generally linearly aligned with the first hinge and they are configured to form the sides of the bin. The second and third regions have attachment means associated therewith for fastening the bin to the wall and further include a support flange associated therewith proximate the base thereof. The planar member further includes a fourth region separated from the first region by the first hinge and has a width which is no greater than the base width of the first region. The fourth region is configured to form the bottom of the bin and is further configured to engage the support flanges of the second and third region so as to be supported and retained thereby.

In accord with the invention, a cluster bin system of the type described hereinabove, further includes an additional living hinge which is disposed within the first (i.e., base forming) region thereof and which extends along the width thereof and divides the first region into two subregions. The hinge allows the base to be folded thereby providing additional rigidity to the base. In this embodiment, the length of the base is generally greater than the distance from the front of the bin to the wall and the folded portion of the base rests upon the wall. In this manner, additional security and rigidity is provided to the bin. This modification is particularly important when the bin is of relatively large size or is used to hold relatively heavy objects.

All of the foregoing embodiments may be utilized in combination with a plurality of track members which are configured to be attached to the wall. The attachment means associated with the bins can engage the track members and retain the bins on the wall. In other modifications, the attachment means are configured to be nailed, screwed or adhesively affixed to the walls.

BRIEF DESCRIPTION OF THE DRAWINGS

FIG. 1 is a top plan view of one embodiment of bin of the present invention as shown in its unfolded form;

FIG. 2 is a side elevational view of the bin of FIG. 1 shown as folded and attached to a track member mounted on a wall;

FIG. 3 A is a top plan view of another embodiment of bin of the present invention shown its unfolded form;

FIG. 3 B is a perspective view of a support member which may be used in combination with the bin of FIG. 3 A;

DETAILED DESCRIPTION OF THE INVENTION

Figure 4:
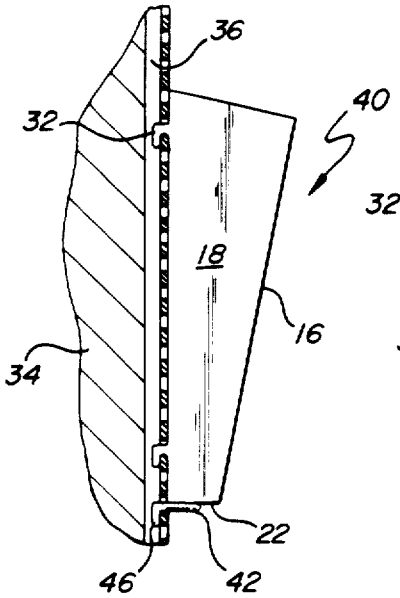
FIG. 4 is a side elevational view of the bin of FIG. 3 B showing it in its folded form and attached to a truck member mounted on a wall and used in combination with the support member of FIG. 3 B.

Referring now to FIG. 1, there is shown a top plan view of a bin of the present invention shown in its unfolded form. The bin 10 is fabricated from a sheet of durable, flexible, light-weight material such as: polyethylene, polypropylene, nylon or other such synthetic polymeric materials as well as thin metal, cardboard and various combinations of the foregoing. The bin may be made of any arbitrary size as dictated by storage needs; however, it is anticipated that the width of the bin will correspond to a multiple of standard wall stud spacing so as to facilitate secure wall mounting. For example, it is a construction standard that wall studs be spaced sixteen inches apart; therefore, the bins may be most advantageously fabricated in sixteen and thirty-two inch widths.

The bin 10 of figure one is shown in flattened form, and it will be noted the bin includes five living hinges embossed therein As used herein, the term "living hinge" is meant to define a hinge formed in, and integral with, a relatively resilient material by rendering a portion of the material more flexible as for example by perforation, tempering, embossing or the forming of a thinner region therein. Hinges of this type are well known to those who are skilled in the art and are utilized in a variety of applications. Typically, living hinges are formed in sheets of polymeric material such as polypropylene, polyethylene, nylon or various reinforced composites.

The FIG. 10 embodiment includes a first living hinge 11, a second living hinge 12, a third living hinge 13, a fourth living hinge 14, and a fifth living hinge 15. The hinges 11-15 divide the bin 10 into six discrete regions, 16, 18, 20, 22, 24 and 26.

The first region 16 forms the front of the bin when the flattened member is folded and it is bounded by hinges 11, 12 and 13. The second and third hinges, 12, 13, define the length of the first region 16, and the separation between the second and third hinges 12 and 13 most proximate the first hinge 11 defines the base width of the first region 16.

The bin 10 further includes a second region 18 and a third region 20 which are approximate mirror images of one another. The second and third regions 18 and 20 are separated from the first region 16 by the second 12 and third 13 hinges respectively. The second 18 and third 20 regions also include means for attaching the bin to the wall, and in the illustrated embodiment such means comprise a plurality of hooks 32 integral with the second 18 and third 20 members. These hooks may be configured to engage slots in wall tracks as will be discussed herein below, although it is to be appreciated that other attachments means such as loops or tabs adapted to receive screws or nails may be similarly employed.

The bin 10 further includes a fourth region 22 which provides the base thereof and which is separated from the first region by the first hinge 11. The bin 10 further includes a fifth region 24 and a sixth region 26 which are mirror images of one another and which are separated from the fourth region 22 by the fourth hinge 14 and the fifth hinge 15 respectively. Each of the fifth 24 and sixth 26 regions includes a hook 32 associated therewith for a fixation to a wall track; although it is to be understood as mentioned above, that other fastening means such as loops or holes adapted to receive nails, screws or similar fasteners may be employed. It is finally to be noted that in the illustrated embodiment, the fourth region 22, includes two cut-out portions at the edge proximate the fourth 14 and fifth 15 hinges. As will be explained in detail below, these cut-outs allow the base of the bin, as formed by the fourth region 22, to clear mounting tracks or other such hardware and provide a close fit to the wall.

In use, the bin then is folded along the hinges 11, 12, 13, 14, 15. The first region 16 forms the front of the bin, the second and third regions 18 and 20 the sides, the fourth region 22 forms the bottom, and the fifth and sixth regions 24 and 26 are folded upward to form support tabs which retain the bottom region 22. The attachment of the bin 10 to a wall is best seen with reference to FIG. 2 which is a side elevational view of the bin 10 of FIG. 1 as folded and attached to a wall 34. The wall 34 includes a track 36 affixed thereto and the wall 34 and track 36 are shown in cross section while the bin 10 is shown in side elevation. The track 36 is configured as an elongated member including a plurality of spaced apart vertical slots 33 therein. The track 36 is affixed to a wall 34 by means of screws, nails or similar hardware, not shown herein. Tracks of this type are well known and widely utilized in the mounting of book shelves and other similar items onto walls.

It will be noted from FIG. 2 that the side walls of the bin 10, as formed by the second 18 and third regions 20 are affixed to the track 36 by means of the hooks 32 integral therewith. The fifth region 24 is folded in the direction of the second region 18 and is affixed to the track 36 by the hook 32. The fifth region 24 provides a support tab which retains the base, provided by the first region 22 of the bin 10 in a closed position. The second region 18 and fifth region 24 are shaped so as to complement one another and enclose the side of the bin 10; toward that end, it will be appreciated that they may be shaped other than as shown herein. The cut-out portions of the fourth region 22 noted in FIG. 1 function to allow the base as provided by the fourth region 22 to clear the track 36 when the unit 10 is affixed to the wall 34.

Referring now to FIGS. 3 A, 3 B, and FIG. 4, there is shown yet another configuration of bin structured in accord with the principles of the present invention. FIG. 3 A depicts a top plan view of an unfolded bin 40 of the type which is used with an external bottom support. The bin 40 of FIG. 3 A is a planar member fabricated from a thin, flexible material similar to that of the bin 10 of FIG. 1. The bin 40 of FIG. 3 A includes three living hinges 11, 12, and 13, generally similar to those described herein above. These hinges divide the bin 40 into a first region 16, second and third regions 18 and 20, and a fourth region 22 generally similar to those described herein above. The bin 40 of FIG. 3 A differs from the bin 10 of figure 1 insofar as the fourth portion 22 thereof does not have any support tabs affixed thereto.

In order to support the bottom of the bin 40 of FIG. 3 A, a separate support member, 42 in FIG. 3 B, is employed. The support member 42 includes an elongated section 44 corresponding in length to the length of the fourth region 22 of the bin 40 and further includes a pair of hooks 46 at opposite ends thereof. The hooks 46 function to affix the support member 42 to a wall track while the elongated region 44 supports the base of the bin 40.

Referring now to FIG. 4 there is shown a side view of the bin 40 of FIG. 3 A as attached to a wall 34 by means of a track 36. It should be noted that the bin 40 includes a side wall formed by the second region 18, a front wall formed by the first region 16 and a bottom formed by the fourth region 22. The support member 42 is retained in the track 36 by means of the hooks 46 and is operable to support the bottom 22 of the bin 40.

Figure 5:
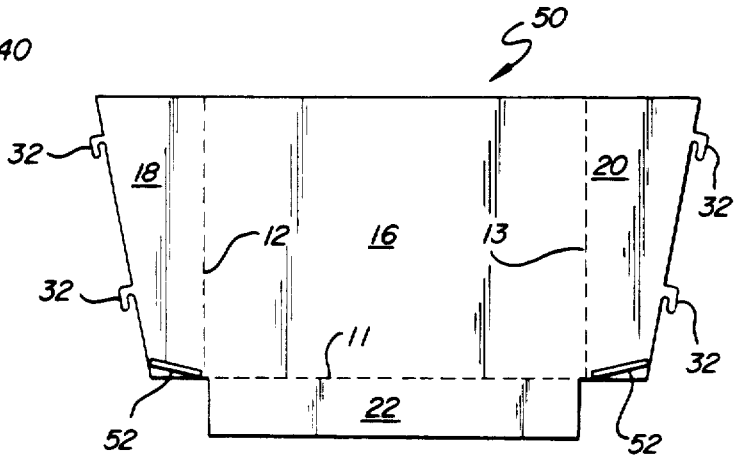
FIG. 5 is a bottom plan view of another bin of the present invention of the type including a bottom support flange.

Referring now to FIG. 5, there is shown yet another embodiment of bin 50 structured in accordance with the principles of the present invention. The bin 50 of FIG. 5 is generally similar to those previously described and like structures are referred to by like reference numerals. The bin 50 of FIG. 5 is shown in a bottom plan view, that is to say the side which faces toward the wall is depicted. The second 18 and third regions 20 each include a flange 52 thereupon. This flange is either molded into the material or alternatively, may be provided as a separately affixed item. The flange may also be provided by turning up a triangular portion of the bottom corner of the second 18 and third regions 20. The flanges 52 operate to support the fourth, 22, base forming region of the bin 50 when it is attached to the wall. While the flange 12 is depicted as being angularly disposed relative to the base of the side-forming second 18 and third 20 regions of the bin 50, it is to be understood that the flanges 52 may be parallel to the base.

In yet another variation of the foregoing, a flange may also be provided along the bottom of the first region 16 and the fourth region 22 may be provided as a discrete member. In this embodiment, the base will be free floating and will be retained by the three flanges when the bin is affixed to the wall.

Figure 6:
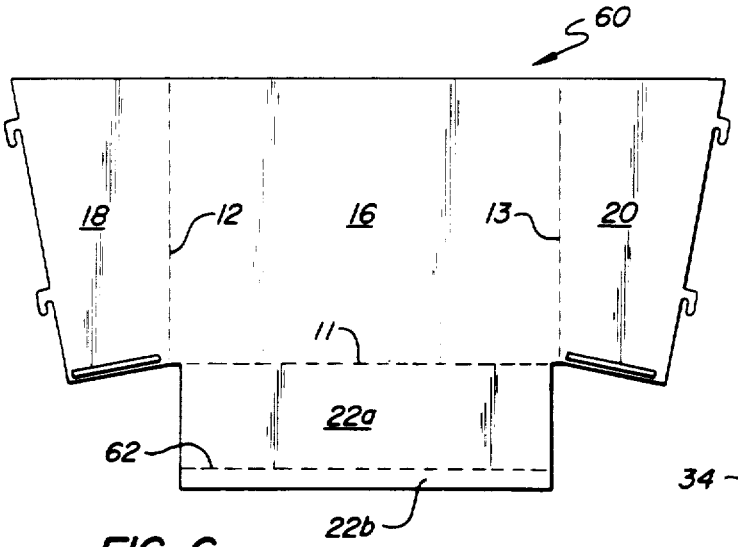
FIG. 6 is a bottom plan view of yet another bin of the present invention including a bottom support flange and a segmented bottom region.

Referring now to FIG. 6, there is shown yet another embodiment of bin 60 structured in accord with the principles of the present invention. The bin 60 of FIG. 6 is generally similar to that of FIG. 5 insofar as it includes a support flange 50. However, the bin 60 of FIG. 6 includes a fourth bottom forming region 22 which is bisected along its width by an additional hinge 62 so as to form two discrete subregions 22*a* and 22*b*. The design of bin 60 shown in FIG. 6 is particularly well suited for storage of large size items. The additional hinge 62, besides providing for flexure of the base, provides additional stiffening to the bottom of the bin. It has been found that by folding the relatively thin material of the bins, additional rigidity may be achieved. In those instances where the base of the bin is relatively large, and/or when relatively heavy items are being stored therein, bowing or sagging of the base is prevented by utilization of the design of FIG. 6.

Figure 7:
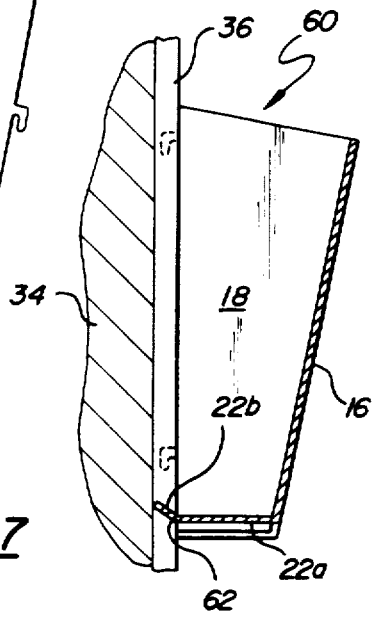
FIG. 7 is a cross sectional view of the bin of FIG. 6 taken along line 7—7 and shown as attached to a wall.

Referring now to FIG. 7, there is shown a cross sectional view of a bin 60 generally similar to that of FIG. 6, taken along line 7—7 and shown as affixed to a wall 34 by means of tracks 36. As in previous embodiments, the first region 16 provides the front of the bin. Clearly shown is the base of the bin as comprised of subregions 22*a* and 22*b*. The first subregion 22*a* is supported by the flanges (52 in FIG. 6), whereas the second subregion 22*b* rests against the surface of the wall 34. The presence of the additional hinge 62 imparts structural integrity to the base of the bin 60 to enable it to resist flexure from heavy loads therein. The embodiment illustrated in FIGS. 6 and 7 may be modified in accord with the teachings of FIGS. 1 and 2, so as to eliminate the flanges 52 and to substitute the attachment tabs 24 and 26 thereof. In such instance, the attachment tabs 24, 26 of FIG. 1 will be associated solely with subregion 22$^a$ and subregion 22$^b$ will be free to engage the wall. Similar modifications may obviously be made in view of the FIG. 3A and 3B embodiments.

It will be appreciated that in view of the foregoing, further modifications and variations of the present invention may be achieved. For example, the bins may include additional hooks for support or they may include other affixation means such as tabs, nails, screws, adhesive and the like. The bins may further include a number of hinges or folds along the bottom or sides thereof to further rigidify them. Corrugation folding of the front and sides may also be employed to prevent flexing under heavy load. All such modifications and variations are within the scope of the present invention. The foregoing drawings, discussion and description are merely meant to be illustrative of particular embodiments of the invention and are not meant to be limitations upon the practice thereof. It is the following claims, including all equivalents, which define the scope of the invention.

I claim:

1. A cluster bin system including: a unitary, planar member configured to be folded into a bin and a wall which is operative to support the planar member, said planar member including five generally linear, living hinges disposed so as to divide the planar member into six regions;

a first region separated from the remainder of said planar member by first, second and third hinges, said first region configured to form the front of the bin when the planar member is folded along the hinges;

a second region and a third region being separated from the first region by the second and third hinges respectively, said second and third regions being approximate mirror images of one another and configured to form the sides of the bin when the planar member is folded along the hinges, said second and third regions each having attachment means associated therewith for fastening the sides of the bin to the wall;

a fourth region being separated from the first region by the first hinge and being configured to form the bottom of the bin when the planar member is folded along the hinges and attached to the wall by said attachment means associated with the second and third region; and a fifth region and a sixth region being separated from said fourth region by fourth and fifth hinges respectively, said fifth and sixth regions being approximate mirror images of one another and each including attachment means associated therewith for fastening the bin to the wall, said fifth and sixth regions configured to form base support tabs when the planar member is folded along the hinges, the fifth and sixth regions operative to support the base of the bin when the attachment means thereon are affixed to the wall.

2. A cluster bin system as in claim 1, wherein said wall includes a plurality of track members attached thereto each track member including a plurality of slots therein; and wherein, the attachment means associated with the second, third, fifth and sixth regions comprise at least one hook configured to be retainably received in one of the slots of the track members.

3. A cluster bin system as in claim 1, wherein said planar member is fabricated from a material selected from a group consisting essentially of synthetic polymeric materials, metals, cardboard, and combinations thereof.

4. A cluster bin system including:

I. unitary, planar member configured to be folded into a bin and attached to a wall, said planar member including a first, a second, and a third generally linear, living hinge disposed so as to divide the planar member into four regions;

a first region having a length defined by said second and third hinges and a base width defined by the separation of the second and third hinges proximate the first hinge, said first region configured to form the front of the bin when the planar member is folded along the hinges;

a second region and a third region being separated from the first region by the second and third hinges respectively, said second and third regions being approximate mirror images of one another and each having a base which is generally linearly aligned with the first hinge, said second and third regions configured to form the sides of the bin when the planar member is folded along the hinges, said second and third regions each having attachment means associated therewith for fastening the bin to the wall; and a fourth region being separated from the first region by the first hinge and having a width which is no greater than the base width of the first region, said fourth region configured to form the bottom of the bin when the planar member is folded along the hinges and attached to the wall by said attachment means; and II. A generally elongated support member having a length generally similar to the width of the fourth region and including attachment means associated with opposite ends thereof, said support member operative to be retained upon said wall and to engage and support the entire width of the bottom of said bin when it is attached to the wall.

5. A cluster bin system as in claim 4, further including a plurality of track members each configured to be attached to the wall and each including a plurality of slots therein; and wherein, the attachment means associated with the second and third regions of the planar member and the attachment means associated with the support member each include at least one hook configured to be retainably received in one of the slots of the track members.

6. A cluster bin system including: a unitary, planar member configured to be folded into a bin and a wall which is operative to support the planar member, said planar member including a first, a second, and a third generally linear, living hinge disposed so as to divide the planar member into four regions;

a first region having a length defined by said second and third hinges and a base width defined by the separation of the second and third hinges proximate the first hinge, said first region configured to form the front of the bin when the planar member is folded along the hinges;

a second and a third region being separated from the first region by the second and third hinges respectively, said second and third regions being approximate mirror images of one another and having a base which is generally linearly aligned with the first hinge, said second and third regions configured to form the sides of the bin when the planar member is folded along the hinges, said second and third regions each having a support flange associated therewith proximate the base thereof and each having attachment means associated therewith for fastening the bin to the wall; and a fourth region being separated from the first region by the first hinge and having a width which is no greater than the base width of the first region, said fourth region configured to form the bottom of the bin when the planar member is folded along the hinges and attached to the wall by the attachment means associated with the second and third regions, said bottom further configured to engage the support flanges of the second and third regions whereby the bottom is retained and supported by the flanges.

7. A cluster bin system as in claim 6 further including a fourth living hinge disposed in a generally parallel relationship with the first living hinge and in the fourth region of said planar member so as to divide the fourth region into, a first and a second subregion having a total length which is greater than the length of the base of the second and third regions, the first subregion of said fourth region disposed between the first and fourth living hinge and configured to engage the support flange of the second and third regions and the second subregion configured to be folded out of the plane of the first subregion and to engage the surface of the wall when the bin is affixed thereto.

8. A cluster bin system as in claim 6 wherein said wall includes a plurality of track members attached thereto each track member including a plurality of slots therein; and wherein, the attachment means associated with the second and third regions each comprise at least one hook configured to be retainably received in one of the slots of the track members.

* * * * *